US011603977B1

(12) United States Patent
Wu

(10) Patent No.: US 11,603,977 B1
(45) Date of Patent: Mar. 14, 2023

(54) HIGH-LOW BEAM SWITCHING DEVICE

(71) Applicant: COPLUS INC., Tainan (TW)

(72) Inventor: Po-Hua Wu, Tainan (TW)

(73) Assignee: COPLUS INC., Tainan (TW)

( * ) Notice: Subject to any disclaimer, the term of this patent is extended or adjusted under 35 U.S.C. 154(b) by 0 days.

(21) Appl. No.: 17/959,544

(22) Filed: Oct. 4, 2022

(30) Foreign Application Priority Data

May 3, 2022 (TW) ..... 111116669

(51) Int. Cl.

| | |
|---|---|
| ***B60Q 1/04*** | (2006.01) |
| ***F21S 41/683*** | (2018.01) |
| ***F21S 41/25*** | (2018.01) |
| ***F21S 41/32*** | (2018.01) |
| ***F21S 45/47*** | (2018.01) |
| ***F21S 41/43*** | (2018.01) |
| ***F21S 41/47*** | (2018.01) |
| ***F21S 41/148*** | (2018.01) |
| *F21W 102/13* | (2018.01) |

(52) U.S. Cl.
CPC ..... *F21S 41/683* (2018.01); *F21S 41/148* (2018.01); *F21S 41/25* (2018.01); *F21S 41/32* (2018.01); *F21S 41/43* (2018.01); *F21S 41/47* (2018.01); *F21S 45/47* (2018.01); *F21W 2102/13* (2018.01)

(58) Field of Classification Search
CPC ..... F21S 41/683; F21S 41/47; F21S 41/148; F21W 2102/13; B60Q 1/04; B60Q 1/14
See application file for complete search history.

(56) References Cited

U.S. PATENT DOCUMENTS 11,047,545 B1 * 6/2021 Chang ..... F21S 41/25

FOREIGN PATENT DOCUMENTS

TW M488419 U * 10/2014

OTHER PUBLICATIONS

SEARCH English translation of TW M488419 U (Year: 2014).*

* cited by examiner

*Primary Examiner* — Omar Rojas Cadima
(74) *Attorney, Agent, or Firm* — Burris Law, PLLC

(57) ABSTRACT

A high-low beam switching device includes a lamp seat mechanism, a light pattern switching unit, and a light pattern tuning mechanism. The light pattern switching unit includes a light occluding plate pivotable relative to the lamp seat mechanism between low and high beam positions. The light pattern tuning mechanism includes a blocking member, an adjusting member operable to move the blocking member forwardly and rearwardly relative to the lamp seat mechanism, thereby adjusting an angle between the light occluding plate and the blocking member when the light occluding plate is pivoted to the low beam position.

8 Claims, 6 Drawing Sheets

HIGH-LOW BEAM SWITCHING DEVICE

CROSS-REFERENCE TO RELATED APPLICATIONS

This application claims priority of Taiwanese Patent Application No. 111116669, filed on May 3, 2022.

FIELD

The disclosure relates to a component of a vehicle headlight, and more particularly to a high-low beam switching device for switching light pattern of the vehicle headlight.

BACKGROUND

Currently, high beam and low beam headlights on vehicles such as automobiles, motorcycles, etc., are mainly provided by a high-low beam switching device cooperating with a light source that emits light. The high-low beam switching device includes a light occluding plate disposed in front of the light source and movable to generate high beams and low beams.

However, fabrication or assembly of the light occluding plate and components of the high-low switching device on which the light occluding plate is mounted might be imprecise, so a cut-off line of the low beam headlight might not comply with regulations. As a result, some of the headlights thus manufactured might not pass quality control, and for these headlights, their structures must be modified to compensate for the fabrication or assembly errors so as to make the cut-off line thereof comply with the regulations and pass quality control, which will significantly increase the manufacturing cost.

SUMMARY

Therefore, the object of the disclosure is to provide a high-low beam switching device capable of alleviating at least one of the drawbacks of the prior art.

According to the disclosure, a high-low beam switching device adapted to be used with a light source is provided. The high-low beam switching device includes a lamp seat mechanism, a light pattern switching unit, and a light pattern tuning mechanism. The lamp seat mechanism is adapted for mounting of the light source and defines a light-reflecting space that is adapted for reflecting light emitted from the light source, and a light output opening that is located at a front end of the light-reflecting space and that is adapted to permit the light reflected in the light-reflecting space to pass forwardly therethrough. The light pattern switching unit includes a light occluding plate, an actuating unit, and a first biasing member. The light occluding plate is pivotally mounted to the lamp seat mechanism, is located in front of the light output opening in a front-rear direction, and partially blocks the light output opening. The actuating unit is mounted to the lamp seat mechanism, is connected to the light occluding plate, and is operable for driving the light occluding plate to pivot between a low beam position and a high beam position. An amount of the light that passes through the light output opening and that is blocked by the light occluding plate increases during pivot action of the light occluding plate from the high beam position to the low beam position. The first biasing member is disposed for biasing the light occluding plate toward the low beam position. The light pattern tuning mechanism includes a blocking member, an adjusting member, and a second biasing member. The blocking member is forwardly and rearwardly movable relative to the lamp seat mechanism. The light occluding plate abuts against the blocking member when being at the low beam position. The adjusting member extends through the blocking member in the front-rear direction and threadedly engages the lamp seat mechanism. The second biasing member is resiliently clamped between the blocking member and the lamp seat mechanism, and biases the blocking element away from the lamp seat mechanism. The adjusting member is operable to move the blocking member forwardly and rearwardly relative to the lamp seat mechanism, thereby adjusting an angle between the light occluding plate and the blocking member when the light occluding plate is pivoted to the low beam position.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
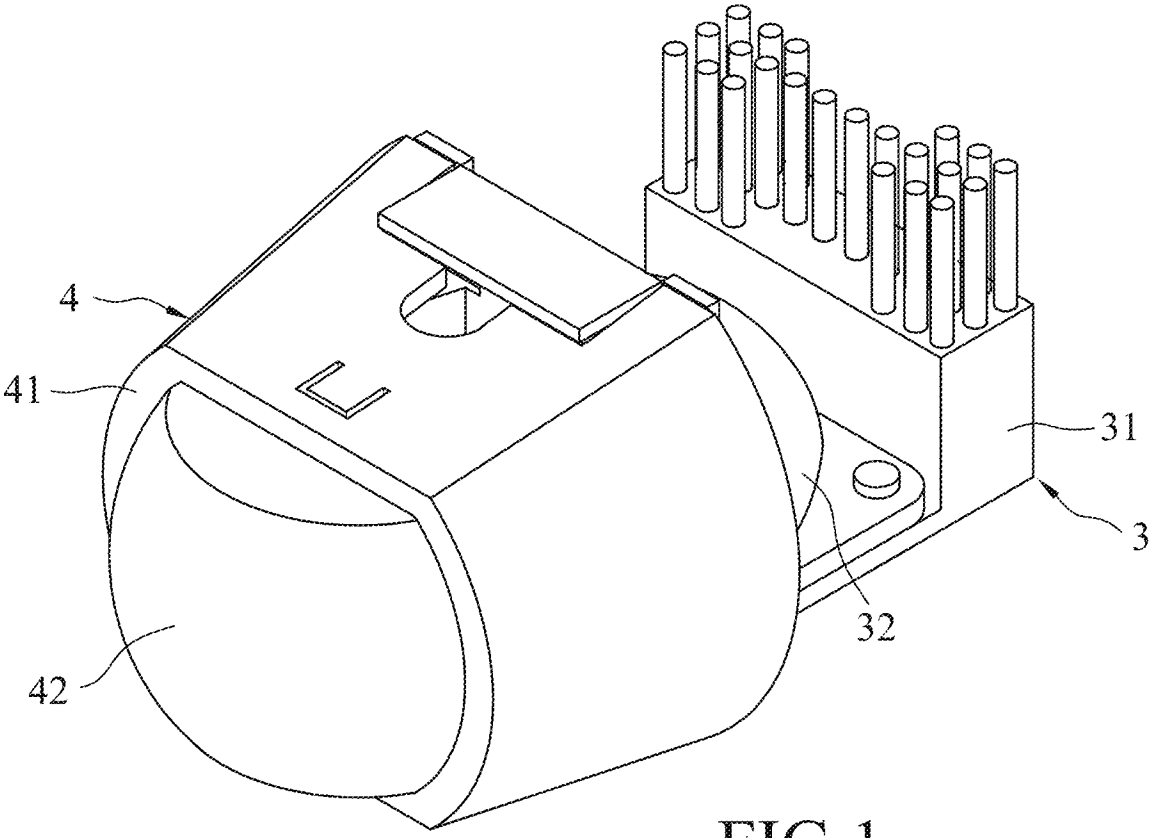
FIG. 1 is a perspective view illustrating an embodiment of a high-low beam switching device according to the present disclosure.
Figure 2:
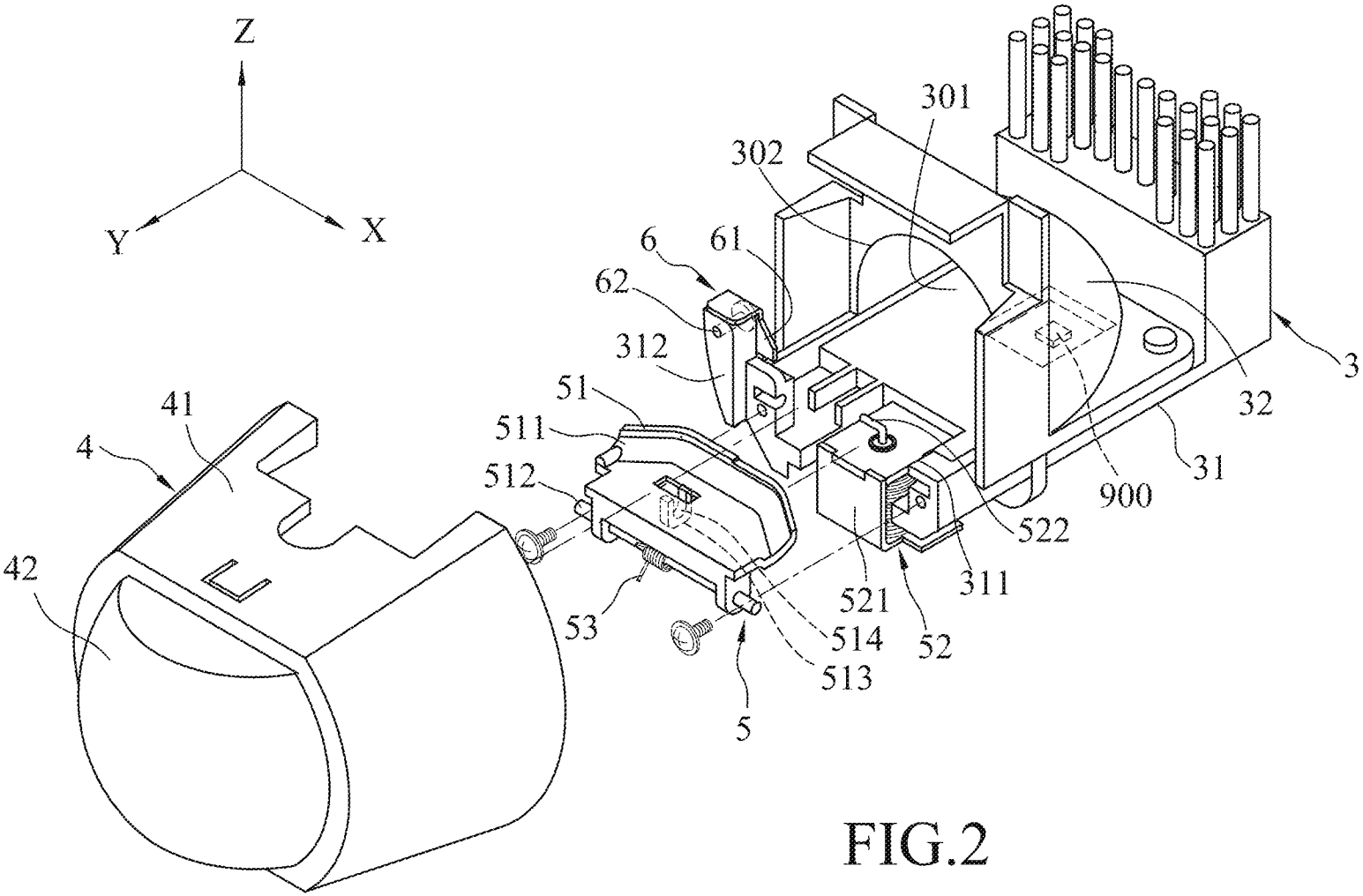
FIG. 2 is a partly exploded perspective view of the embodiment.
Figure 3:
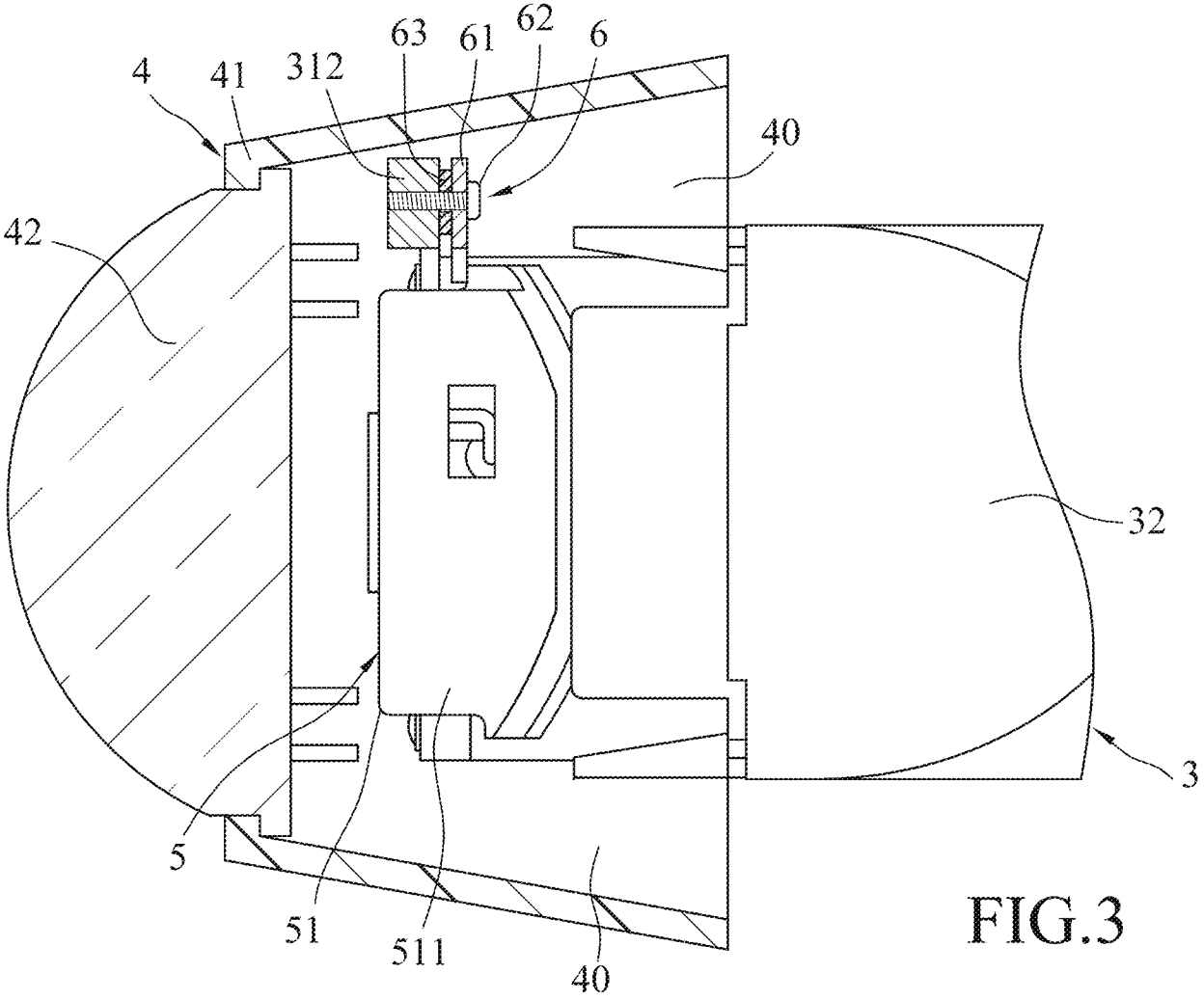
FIG. 3 is a schematic sectional top view, illustrating the structure of the embodiment.

Referring to FIGS. 1, 2, and 3, an embodiment of a high-low beam switching device of the present disclosure is adapted to be used with a light source 900 to form a vehicle headlight. The high-low beam switching device includes a lamp seat mechanism 3 that is adapted for mounting of the light source 900, a lamp shield 4 that opens rearwardly and that covers a front portion of the lamp seat mechanism 3, and a light pattern switching unit 5 and a light pattern tuning mechanism 6 that are covered by the lamp shield 4.

The lamp seat mechanism 3 includes a base seat 31 that is adapted for mounting of the light source 900, and a reflector shield 32 that is mounted to a top side of the base seat 31. The reflector shield 32 cooperates with the base seat 31 to define a light-reflecting space 301 and a light output opening 302 therebetween. The light-reflecting space 301 is adapted for reflecting light emitted from the light source 900. The light output opening 302 is located at a front end of the light-reflecting space 301 in a front-rear direction (Y), and is adapted to permit the light reflected in the light-reflecting space 301 to pass forwardly therethrough and then to project forwardly through the lamp shield 4.

The base seat 31 has a retaining groove 311 formed through a front end of the base seat 31 in an up-down direction (Z) that is transverse to the front-rear direction (Y) and disposed in front of and lower than the light output opening 302, and a mounting portion 312 disposed in front of the reflector shield 32 and extending laterally beyond one of left and right portions of the reflector shield 32. In this embodiment, the mounting portion 312 extends beyond the right portion of the reflector shield 32, and may extend beyond the left portion of the reflector shield 32 in other embodiments.

The lamp shield 4 includes a ring-shaped shield body 41 sleeved on the front portion of the lamp seat mechanism 3, and a lens 42 mounted to a front end of the shield body 41. The shield body 41 has an inner surface. A distance between left and right ends of the inner surface in a left-right direction (X), which is transverse to the up-down direction (Z) and the front-rear direction (Y), is greater than a width of the reflector shield 32 in the left-right direction (X), and the shield body 41 cooperates with the left and right portions of the reflector shield 32 to respectively define two operating spaces 40 opening rearwardly. The lens 42 is adapted to permit the light passing through the light output opening 302 and passing over the light occluding plate 51 to project forwardly therethrough to form a low beam light pattern or a high beam light pattern. The mounting portion 312 of the base seat 31 is exposed to the right one of the operating spaces 40 defined between the shield body 41 and the right portion of the reflector shield 32.

Figure 4:
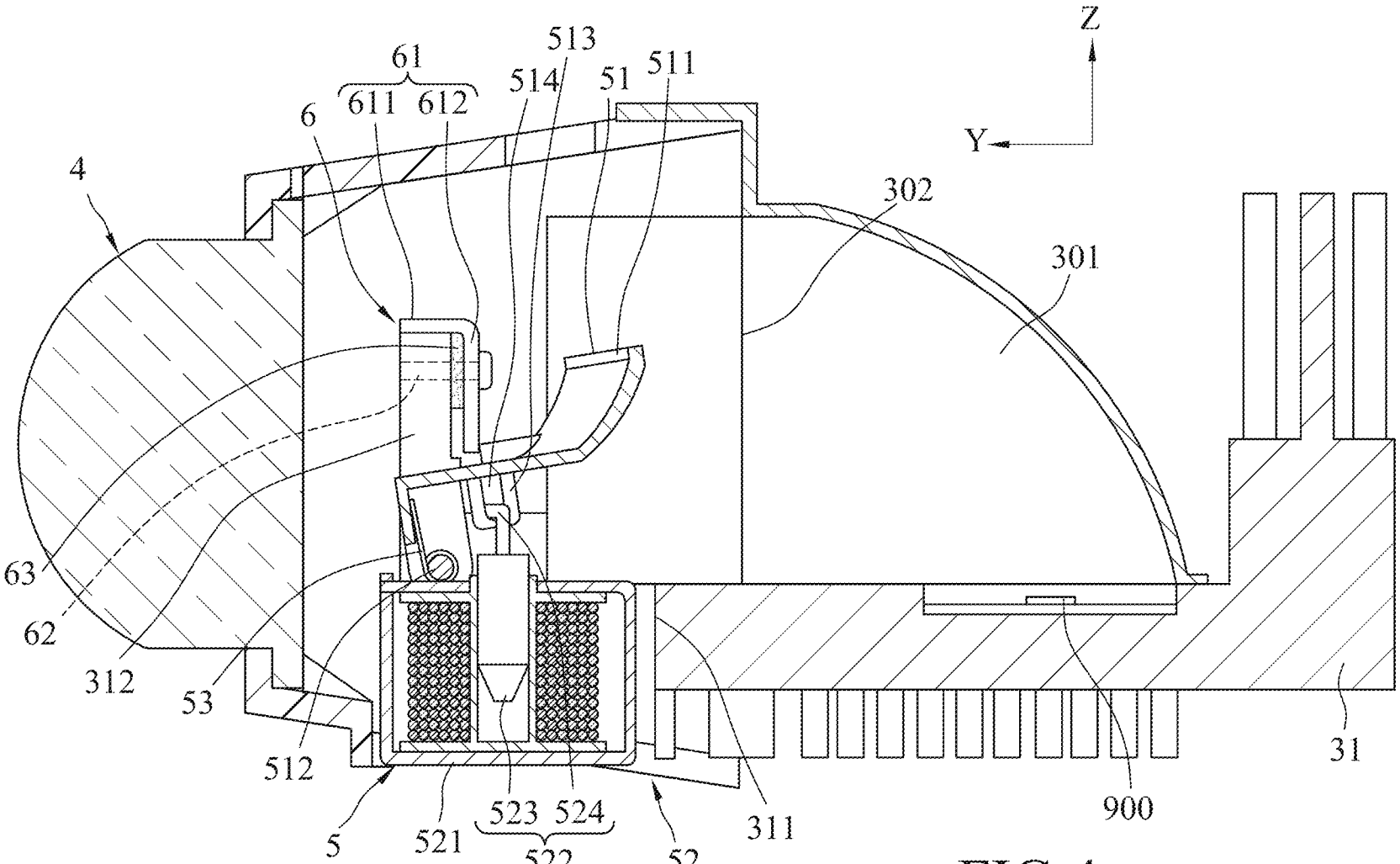
FIG. 4 is a schematic sectional side view, illustrating a light occluding plate of the embodiment at a low beam position.
Figure 5:
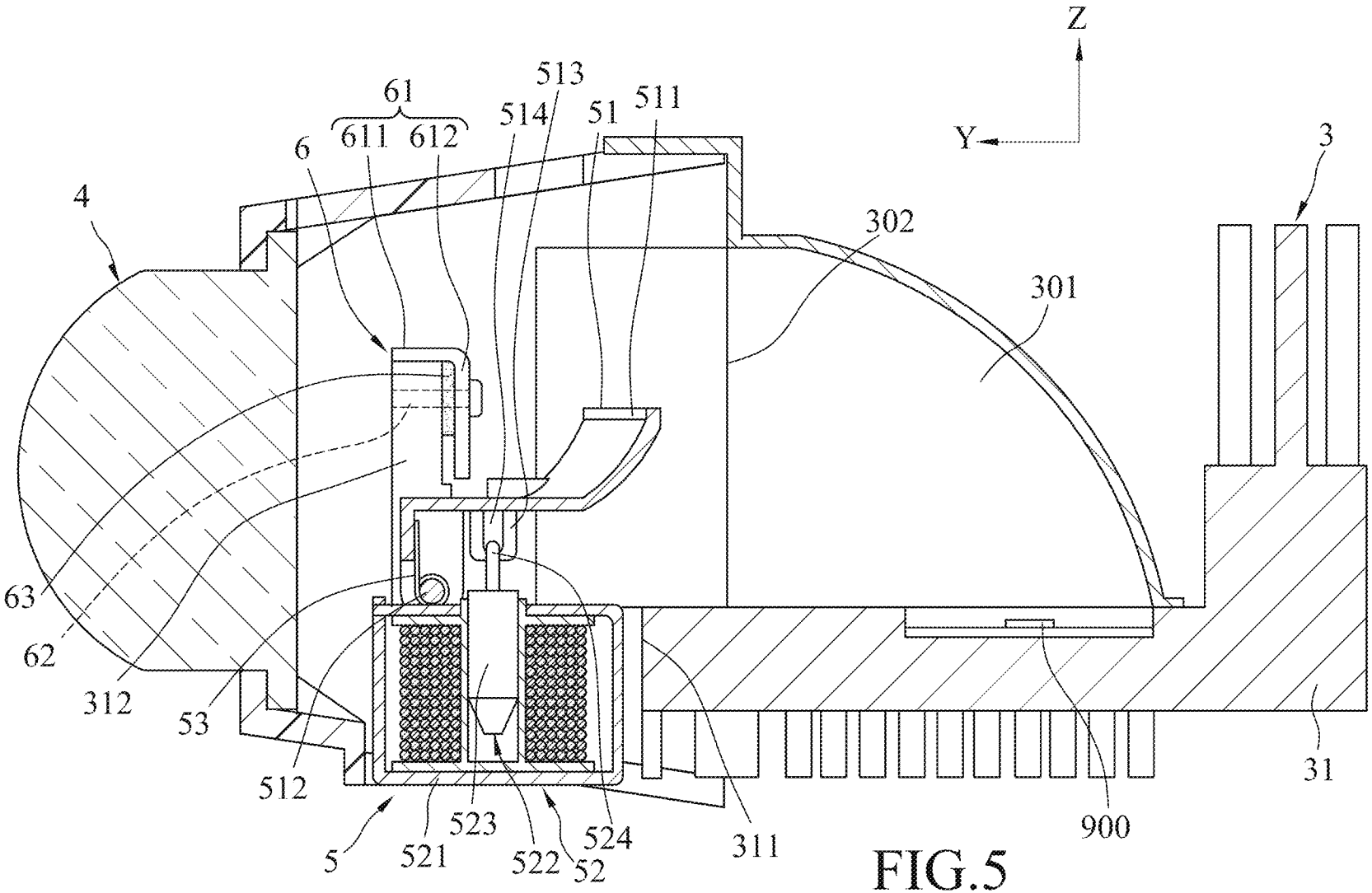
FIG. 5 is a view similar to FIG. 4, illustrating the light occluding plate at a high beam position.

Referring to FIGS. 2, 4, and 5, the light pattern switching unit 5 includes a light occluding plate 51 pivotally mounted to the base seat 31, located in front of the light output opening 302, and disposed over the base seat 31, an actuating unit 52 mounted to the base seat 31 and connected to the light occluding plate 51, and a first biasing member 53 disposed between the light occluding plate 51 and the actuating unit 52.

The light occluding plate 51 includes a light baffle portion 511 disposed over the retaining groove 311 of the base seat 31 and adapted for patterning the light that exits from the light output opening 302, a pivot portion 512 interconnecting pivotally the base seat 31 and the light baffle portion 511 and serving as a pivot of the light occluding plate 51, and a lug portion 513 extending downwardly from a bottom surface of the light baffle portion 511 toward the retaining groove 311. The lug portion 513 has a through hole 514 extending therethrough in the left-right direction (X) and being elongated in the up-down direction (Z).

The actuating unit 52 is operable for driving the light occluding plate 51 to pivot toward and away from the light pattern tuning mechanism 6 between a low beam position (see FIG. 4) and a high beam position (see FIG. 5). An amount of the light that passes through the light output opening 302 and that is blocked by the light occluding plate 51 increases during pivot action of the light occluding plate 51 from the high beam position to the low beam position. When the light occluding plate 51 is at the low beam position, the light projecting forwardly through the lamp shield 4 forms a low beam light pattern. On the other hand, after the light occluding plate 51 is driven to pivot downwardly toward the base seat 31 to the high beam position, the amount of the light passing through the light output opening 302 and blocked by the light occluding plate 51 decreases so that the light projecting forwardly through the lamp shield 4 forms a high beam light pattern.

The actuating unit 52 includes a driving device 521 mounted in the retaining groove 311, and an actuating rod 522 mounted to the driving device 521, being upwardly and downwardly movable, and connected to the lug portion 513. Specifically, the actuating rod 522 has a main rod portion 523 extending in the up-down direction (Z) and inserted movably into the driving device 521, and a transverse rod portion 524 extending transversely from a top end of the main rod portion 523 and through the through hole 514 of the lug portion 513 and movable in the up-down direction (Z). The transverse rod portion 524 has an outer diameter smaller than a dimension of the through hole 514 and is co-movable with the actuating rod 522 to pull the lug portion 513 downwardly.

The driving device 521 is operable to be activated to drive the actuating rod 522 to move downwardly and to pull the lug portion 513 downwardly, so that the light baffle portion 511 of the light occluding plate 51 pivots toward the base seat 31 to move the light occluding plate 51 from the low beam position to the high beam position. In this embodiment, the driving device 521 is a solenoid valve that may be energized to generate a magnetic force that attracts the actuating rod 522 that is made of ferromagnetic material to move downwardly, and the driving device 521 stops to attract the actuating rod 522 when being turned off. Note that the material and configurations of the driving device 521 and the actuating rod 522 described herein are merely an example and may be modified in other embodiments.

In this embodiment, the first biasing member 53 is a torsion spring, is co-axial with the pivot portion 512, and resiliently abuts against and is disposed between the light occluding plate 51 and the driving device 521. The biasing member 53 provides a restoring force for biasing the light occluding plate 51 to pivot upwardly and away from the driving device 521 toward the low beam position. In this way, when the actuating rod 522 is not driven by the driving device 521 to pull the lug portion 513 of the light occluding plate 51 downwardly, the restoring force provided by the first biasing member 53 drives the light occluding plate 51 to pivot upwardly relative to the base seat 31 to be restored from the high beam position to the low beam position.

In other embodiments of the present disclosure, the first biasing member 53 may be disposed between the light occluding plate 51 and the lamp seat mechanism 3 for driving the light occluding plate 51 to pivot toward the low beam position. The configuration and arrangement of the first biasing member 53 may be modified as long as the first biasing member 53 is capable of driving the light occluding plate 51 to the low beam position, and the implementation manner of the first biasing member 53 is not limited to the abovementioned examples.

Referring to FIGS. 2, 3, and 4, the light pattern tuning mechanism 6 includes a blocking member 61 disposed behind the mounting portion 312 of the base seat 31, and forwardly and rearwardly movable relative to the mounting portion 312, an adjusting member 62 extending through the blocking member 61 in the front-rear direction (Y) and threadedly engaging the mounting portion 312, and a second biasing member 63 being resiliently clamped between the blocking member 61 and the mounting portion 312. The second biasing member 63 provides a restoring force for biasing the blocking member 61 rearwardly relative to the mounting portion 312. In this embodiment, the second biasing member 63 is a resilient pad, but in other embodiments of the present disclosure, the second biasing member 63 may be implemented by a spring and is not limited to the above example.

The blocking member 61 includes an overlapping portion 611 disposed on a top surface of the mounting portion 312, and a limiting portion 612 extending downwardly from a rear side of the overlapping portion 611, and disposed behind and spaced apart from the mounting portion 312. The light occluding plate 51 is biased to abut against the limiting portion 612 of the blocking member 61 when being at the low beam position.

The adjusting member 62 extends through the limiting portion 612 and the second biasing member 63 in the front rear direction (Y), and is operable to move the blocking member 61 forwardly and rearwardly relative to the mounting portion 312 of the lamp seat mechanism 3, thereby adjusting an angle between the light occluding plate 51 and the blocking member 61 when the light occluding plate 51 is pivoted to the low beam position. In this way, a position in height of a top end of the light baffle portion 511 of the light occluding plate 51 is adjusted, and thus the light pattern formed by the light that passes over the light baffle portion 511 and that projects forwardly through the lamp shield 4 may be adjusted.

Referring to FIGS. 2, 4, and 5, after the high-low beam switching device of the present disclosure is mounted on a vehicle, and cooperates with the light source 900 and other components to form a vehicle headlight of the vehicle, when the actuating unit 52 is not activated, the light occluding plate 51 is biased by the first biasing member 53 to the low beam position where the light occluding plate 51 abuts against the blocking member 61. At this position, the light emitted from the light source 900 is first reflected in the light-reflecting space 301, passes forwardly through the light output opening 302, and then passes over the light occluding plate 51 and through the light shield 4 to form the low beam light pattern. When the driving device 521 of the actuating unit 52 is activated, the driving device 521 drives the actuating rod 522 to pull the light occluding plate 51 downwardly from the low beam position to the high beam position, and thus the light passing over the light occluding plate 51 and passing through the lamp shield 4 projects forwardly to form the high beam light pattern. At this position, the first biasing member 53 is twisted to store a restoring force. When the driving device 521 is not activated, the light occluding plate 51 is driven by the restoring force of the first biasing member 53 to pivot upwardly until the light occluding plate 51 abuts against the blocking member 61 and is restored to the low beam position.

Figure 6:
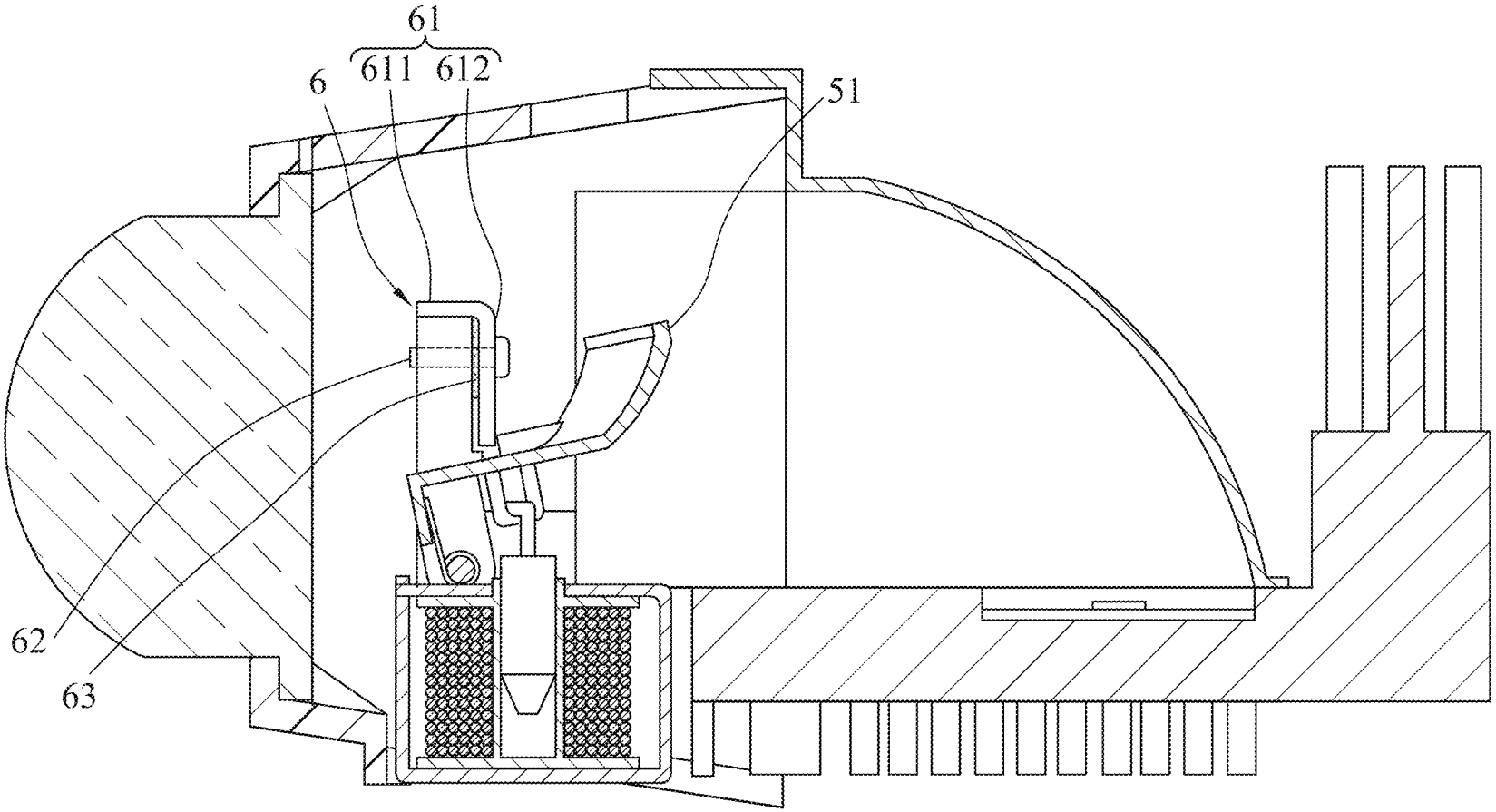
FIG. 6 is a view similar to FIG. 4, illustrating a second biasing member being compressed and a blocking member that the light occluding plate abuts against being moved forwardly as compared to FIG. 4.

In a case where the components of the vehicle headlight are not precisely manufactured or assembled, the low beam light pattern formed by the light source 900 may not comply with regulations, e.g., a cut-off line of the low beam light pattern does not comply with the regulations. Referring to FIGS. 3, 4, and 6, a screw driver (not shown) may be brought into the right one of the operating spaces 40 (see FIG. 3) to drive the adjusting member 62 to rotate so the blocking member 61 is moved forwardly and rearwardly. For example, the blocking member 61 may be moved slightly and forwardly to compress the second biasing member 63, and to thereby adjust the angle between the light occluding plate 51 and the blocking member 61 when the light occluding plate 51 is at the low beam position, thereby adjusting the cut-off line of the low beam light pattern to ensure that the low beam light pattern complies with the regulations.

In summary, by virtue of the structural design of the light pattern switching unit 5 and the light pattern tuning mechanism 6, the position of the blocking member 61 may be adjusted forwardly and rearwardly to a slight extent by simply rotating the adjusting member 62, thus the angle between the light occluding plate 51 and the blocking member 61 may be fine-tuned to thereby adjust the cut-off line of the low beam light pattern thus formed and to provide the low beam light pattern in compliance with the regulations without replacing parts of the vehicle headlight or reassembling the vehicle headlight.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A high-low beam switching device adapted to be used with a light source, comprising:

a lamp seat mechanism adapted for mounting of the light source and defining a light-reflecting space that is adapted for reflecting light emitted from the light source, and a light output opening that is located at a front end of said light-reflecting space and that is adapted to permit the light reflected in said light-reflecting space to pass forwardly therethrough;

a light pattern switching unit including a light occluding plate that is pivotally mounted to said lamp seat mechanism, that is located in front of said light output opening in a front-rear direction, and that partially blocks said light output opening, an actuating unit that is mounted to said lamp seat mechanism, that is connected to said light occluding plate, and that is operable for driving said light occluding plate to pivot between a low beam position and a high beam position, an amount of the light that passes through said light output opening and that is blocked by said light occluding plate increasing during pivot action of said light occluding plate from the high beam position to the low beam position, and a first biasing member that is disposed for biasing said light occluding plate toward the low beam position; and a light pattern tuning mechanism including a blocking member that is forwardly and rearwardly movable relative to said lamp seat mechanism, said light occluding plate abutting against said blocking member when being at the low beam position, an adjusting member that extends through said blocking member in the front-rear direction, and that threadedly engages said lamp seat mechanism, and a second biasing member that is resiliently clamped between said blocking member and said lamp seat mechanism and that biases said blocking element away from said lamp seat mechanism, said adjusting member being operable to move said blocking member forwardly and rearwardly relative to said lamp seat mechanism, thereby adjusting an angle between said light occluding plate and said blocking member when said light occluding plate is pivoted to the low beam position.

2. The high-low beam switching device as claimed in claim 1, further comprising a lamp shield opening rearwardly, covering a front portion of said lamp seat mechanism, and adapted for permitting the light passing through said light output opening and passing over said light occluding plate to project forwardly therethrough.

3. The high-low beam switching device as claimed in claim 2, wherein:

said lamp shield includes a ring-shaped shield body sleeved on said front portion of said lamp seat mechanism, and a lens mounted to a front end of said shield body;

said shield body cooperates with one of left and right portions of said lamp seat mechanism to define an operating space that opens rearwardly; and said lamp mechanism includes a mounting portion exposed to said operating space, said adjusting member threadedly engaging said mounting portion.

4. The high-low beam switching device as claimed in claim 3, wherein said lamp seat mechanism includes a base seat adapted for mounting of the light source and having said mounting portion, and a reflector shield mounted to a top side of said base seat and cooperating with said base seat to define said light-reflecting space and said light output opening therebetween, said light pattern switching mechanism being mounted to said base seat.

5. The high-low beam switching device as claimed in claim 4, wherein:

said base seat has a retaining groove formed through a front end thereof in an up-down direction that is transverse to the front-rear direction, and disposed in front of and lower than said light output opening;

said light occluding plate has a light baffle portion disposed over said base seat and adapted for patterning the light that exits said light output opening, a pivot portion interconnecting pivotally said base seat and said light baffle portion and serving as a pivot of said light occluding plate, and a lug portion extending downwardly from a bottom surface of said light baffle portion toward said retaining groove;

said actuating unit includes a driving device mounted in said retaining groove, and an actuating rod mounted to said driving device and connected to said lug portion, said driving device being operable to drive said actuating rod to pull said lug portion downwardly so that said light baffle portion pivots toward said base seat to move said light occluding plate from the low beam position to the high beam position, and that said first biasing member is driven by said light occluding plate to store a restoring force; and said light occluding plate is driven by the restoring force of said first biasing member to pivot to the low beam position when said actuating rod is not driven to pull said lug portion.

6. The high-low beam switching device as claimed in claim 5, wherein said lug portion has a through hole extending therethrough in a left-right direction transverse to the up-down direction and the front-rear direction, said actuating rod engaging said through hole of said lug portion.

7. The high-low beam switching device as claimed in claim 6, wherein said through hole of said lug portion is elongated in the up-down direction, said actuating rod having a main rod portion that extends in the up-down direction and that is mounted to said driving device and a transverse rod portion that extends transversely from a top end of said main rod portion and through said through hole and that is movable in the up-down direction.

8. The high-low beam switching device as claimed in claim 1, wherein said second biasing member is a resilient pad resiliently clamped between said blocking member and said lamp seat mechanism.

* * * * *